US009733026B2

(12) United States Patent
Stieger

(10) Patent No.: US 9,733,026 B2
(45) Date of Patent: Aug. 15, 2017

(54) HEAT EXCHANGER WITH FLUID GUIDING MEMBERS

(75) Inventor: Rory Douglas Stieger, Derby (GB)

(73) Assignee: ROLLS ROYCE plc, London (GB)

( * ) Notice: Subject to any disclaimer, the term of this patent is extended or adjusted under 35 U.S.C. 154(b) by 712 days.

(21) Appl. No.: 13/695,998

(22) PCT Filed: May 23, 2011

(86) PCT No.: PCT/EP2011/058376

§ 371 (c)(1),
(2), (4) Date: Nov. 2, 2012

(87) PCT Pub. No.: WO2011/154241

PCT Pub. Date: Dec. 15, 2011

(65) Prior Publication Data

US 2013/0048259 A1 Feb. 28, 2013

(30) Foreign Application Priority Data

Jun. 10, 2010 (GB) ..... 1009701.2

(51) Int. Cl.
*F28F 3/08* (2006.01)
*F28F 9/02* (2006.01)
*F28D 9/00* (2006.01)

(52) U.S. Cl.
CPC ..... *F28F 9/0265* (2013.01); *F28D 9/0037* (2013.01); *Y10T 29/4935* (2015.01)

(58) Field of Classification Search
CPC .. F28D 9/00; F28D 9/0037; F28F 3/00; F28F 9/0265
USPC ..... 165/52, 165, 166
See application file for complete search history.

(56) References Cited

U.S. PATENT DOCUMENTS 2,812,165 A * 11/1957 Hammond ..... F28D 9/00 165/166
3,291,206 A * 12/1966 Nicholson ..... F28D 9/0037 165/166
3,968,834 A * 7/1976 Mangus et al. ..... 165/82
4,913,776 A * 4/1990 Finnemore ..... F28D 9/0025 165/166
2003/0056943 A1* 3/2003 Dessiatoun et al. ..... 165/142
2010/0132921 A1* 6/2010 Moskal et al. ..... 165/104.19
2010/0300647 A1* 12/2010 Steurer ..... F28D 21/0003 165/52

FOREIGN PATENT DOCUMENTS

DE 201 21 112 U1 4/2003
DE 203 07 881 U1 9/2004
(Continued)

OTHER PUBLICATIONS

Description DE102010015371 machine translation.*
(Continued)

*Primary Examiner* — Len Tran
*Assistant Examiner* — Gordon Jones
(74) *Attorney, Agent, or Firm* — Oliff PLC

(57) ABSTRACT

A heat exchanger includes a heat exchanger core, a fluid path through the heat exchanger core, and a fluid guiding member. The fluid path has an inlet and an outlet. The fluid guiding member is adjacent to the inlet and/or outlet of the fluid path. The fluid guiding member is operable to change the direction of fluid flow.

7 Claims, 12 Drawing Sheets

(56) References Cited

FOREIGN PATENT DOCUMENTS

| | | | | | |
|---|---|---|---|---|---|
| DE | 102010015371 | A1 * | 10/2011 | ..... | F28D 9/0068 |
| EP | 0 984 238 | A2 | 3/2000 | | |
| EP | 1 050 618 | A1 | 11/2000 | | |
| EP | 1 748 271 | A1 | 1/2007 | | |
| FR | 918 616 | A | 2/1947 | | |

OTHER PUBLICATIONS

DE 102010015371 A1 machine translation.*
International Search Report issued in International Application No. PCT/EP2011/058376 dated Jul. 4, 2011.
Written Opinion of the International Searching Authority issued in International Application No. PCT/EP2011/058376 dated Jul. 4, 2011.

* cited by examiner

HEAT EXCHANGER WITH FLUID GUIDING MEMBERS

The present invention relates to a heat exchanger and particularly but not exclusively to a heat exchanger for use as an intercooler in a primary gas path of a gas turbine engine.

In order to increase the efficiency of a gas turbine engine, it is known to cool the gas during compression. For example, where the compressor system comprises a low pressure compressor and a high pressure compressor in succession, a heat exchanger, known as an intercooler, may be used between the two compressors to reduce the temperature of the gas entering the high pressure compressor. By lowering the temperature of the gas the high pressure compressor can compress the gas with lower power input, thus improving the power output of the engine.

Aerospace air-air heat exchangers typically only provide cooling to a small fraction of the engine core flow. Such heat exchangers are subject to considerable size and weight constraints. In a limited space, the heat exchanger may be installed in a V-shaped arrangement so as to increase the heat exchanger core frontal area. This may also reduce the flow path length within the heat exchanger and thus reduce the heat exchanger pressure losses.

An example of the increased frontal area achieved with this method is shown in FIG. 1 which is a top view of a heat exchanger installation of unit depth into the page. As shown, the heat exchangers 2 and 2' are installed in the same cross-sectional area A. The heat exchangers 2 and 2' are of the same volume (AL=A'L'). However, the heat exchanger 2' is installed at an angle θ in the area A. Consequently, the area A of the heat exchanger 2 is given by $A=A' \sin\theta+L' \cos\theta$. From this it follows that the frontal area A' of the heat exchanger 2' is given by $A'=(A+\mathrm{sqrt}(A^2-4AL \sin\theta \cos\theta))/2 \sin\theta$.

Intercoolers used in industrial engines, i.e. for power generation, are not subject to the space and weight constraints of aerospace applications. Consequently, these intercoolers may be comparable in size to the core engine and are capable of cooling the full engine core flow.

In aerospace applications, the tight space constraints lead to designs with small flow area in the manifolds relative to the heat exchanger core. This results in large flow velocities in the manifolds together with large decelerations into the core and large accelerations out of the core. This may lead to high levels of aerodynamic loss and poor flow distribution within the heat exchanger, which can cause a significant degradation in the heat transfer performance of the heat exchanger.

These tight space constraints also lead to large heat exchanger installation angles which require the flow to turn through large angles at inlet and exit to the heat exchanger core. These high levels of turning can result in large pressure losses and poor flow distribution, again resulting in degradation of the heat transfer performance of the heat exchanger.

The present invention seeks to provide a heat exchanger which optimises the flow path through the heat exchanger so as to promote heat transfer performance.

In accordance with an aspect of the invention there is provided a heat exchanger comprising: a heat exchanger core; a fluid path through the heat exchanger core, the fluid path having an inlet and an outlet; and a fluid guiding member adjacent to the inlet and/or outlet of the fluid path, the fluid guiding member being operable to change the direction of fluid flow.

The fluid guiding member may change the direction of fluid flow by approximately 30 degrees at the inlet of the fluid path and/or approximately 75 degrees at the outlet of the fluid path.

The fluid guiding member may provide a change in the flow direction at the inlet and/or outlet to the heat exchanger core. This provides a significant improvement in flow distribution within the heat exchanger core which improves the heat transfer performance of the heat exchanger. This is particularly significant in a heat exchanger core installed at a large angle relative to the manifold flow direction.

The heat exchanger core may comprise a plurality of heat exchanger plates; the fluid path running between adjacent heat exchanger plates and having an inlet at one side of the heat exchanger plates and an outlet at an opposing side of the heat exchanger plates.

The heat exchanger plates may comprise corrugations.

The corrugations may promote turbulence and/or mixing within the flow, thus improving the heat transfer and the efficiency of the heat exchanger.

The fluid guiding member may comprise an angled portion of each heat exchanger plate which is angled with respect to the remainder of the heat exchanger plate, the angled portion being adjacent to the inlet and/or outlet side of the heat exchanger plate.

The geometry of the heat exchanger plates may be sheared such that the corrugations are not distorted by the angled portion.

The fluid guiding member may comprise a curved plate adjacent to the inlet and/or outlet side of one or more of the heat exchanger plates.

The fluid guiding member may comprise an aerofoil portion which is located between the fluid paths of neighbouring pairs of heat exchanger plates.

The angled portion with sheared geometry is most practical through turning angles up to 45 degrees. Although possible for larger angles the geometry may become less practical. Consequently, the curved plate and aerofoil portion guiding members may be used instead of or as well as the angled portion at these larger angles.

Aerofoil portions may be located between alternate neighbouring pairs of heat exchanger plates.

This increases the mean free passage area and thus reduces clogging in the heat exchanger core.

Aerofoil portions may be located between neighbouring pairs of hear exchanger plates, and the aerofoil portions of adjacent neighbouring pairs of heat exchanger plates may be dissimilar.

This configuration provides turning of the flow whilst maintaining a suitably large mean free passage area.

The fluid guiding member may be integral with the heat exchanger plates.

The heat exchanger may be used in a gas turbine engine, particularly as an intercooler.

In accordance with another aspect of the invention there is provided a method of producing a cross-corrugated heat exchanger plate with an angled portion, the method comprising: providing two sheets of material; forming corrugations at an oblique angle across a surface of each sheet; shearing the geometry of a portion of the sheets at the location of the angled portion; and joining the two sheets together.

Shearing the geometry may comprise extruding the portion at an angle.

For a better understanding of the present invention, and to show more clearly how it may be carried into effect, reference will now be made, by way of example, to the accompanying drawings, in which.

Figure 1:
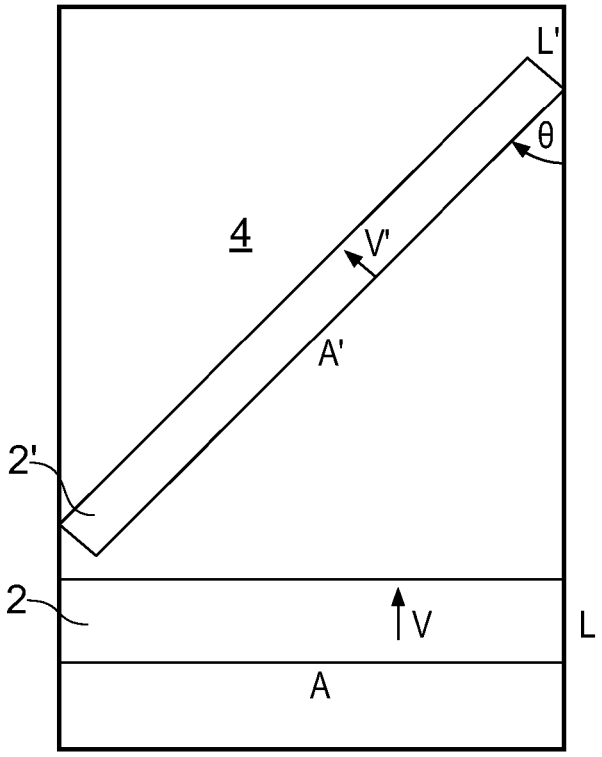
FIG. 1 is a schematic view of a heat exchanger core illustrating the increased frontal area achieved by angling the heat exchanged with respect to the flow.
Figure 2:
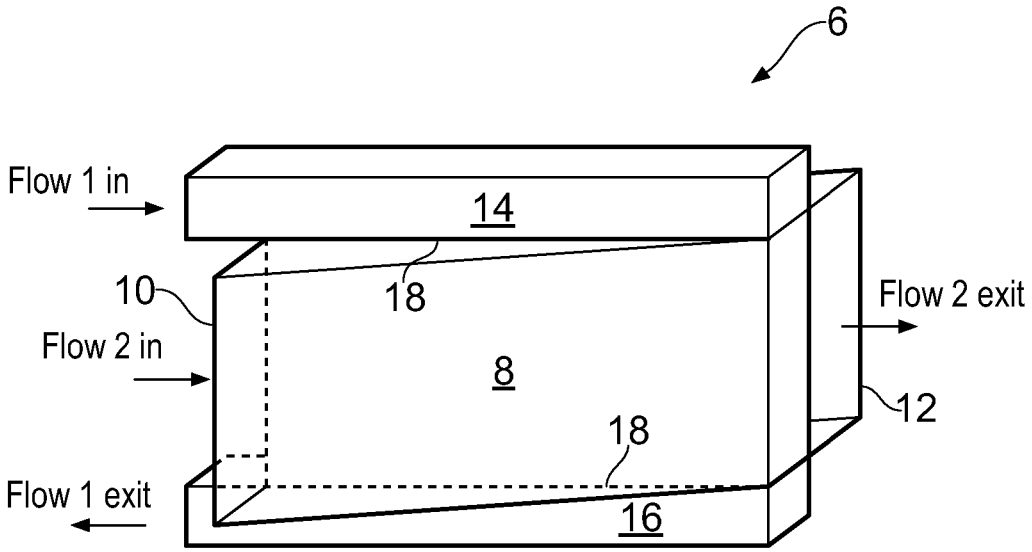
FIG. 2 is a perspective view of a cross-flow heat exchanger.

FIG. 2 shows a heat exchanger 6 according to an embodiment of the invention. The heat exchanger 6 is a cross flow heat exchanger and comprises a heat exchanger core 8. The heat exchanger core 8 has a substantially rectangular cuboid shape. A first inlet header 14 and first outlet header 16 are fluidically coupled to the heat exchanger core 8 across long sides 18 of the rectangular cuboid. A second inlet header 10 and outlet header 12 are fluidically coupled to the heat exchanger core 8 across the opposing sides of the rectangular cuboid.

Figure 4:
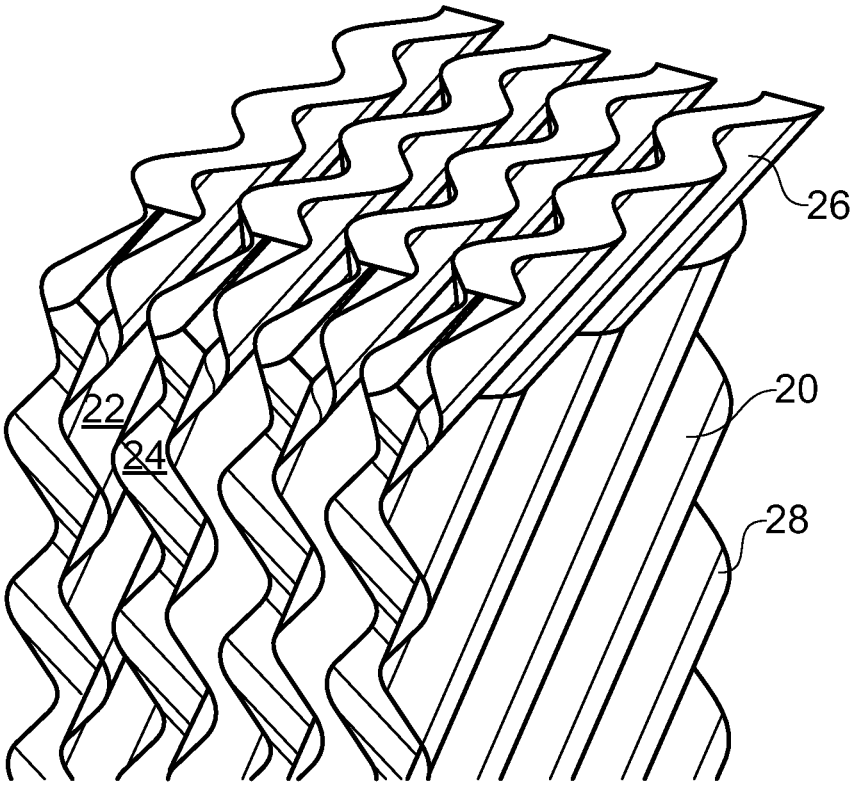
FIG. 4 is a perspective view of an embodiment of a heat exchanger according to an aspect of the invention.

The heat exchanger core 8 comprises a plurality of heat exchanger plates 20 (see FIG. 4). The heat exchanger plates 20 extend across the heat exchanger core 8 between the inlet header 14 and outlet header 16. The heat exchanger plates 20 are oriented in a plane which is substantially parallel to the long sides 18 of the rectangular cuboid.

Adjacent heat exchanger plates 20 form a fluid path through the heat exchanger core. The adjacent heat exchanger plates are closed along two sides to define the fluid path. Alternate pairs 22 of heat exchanger plates 20 are interconnected such that the fluid path runs from the inlet header 14 to the outlet header 16, with intermediate pairs 24 of heat exchanger plates 20 being interconnected such that the fluid path runs from the first narrow side 10 to the second narrow side 12.

A first flow, Flow 1, passes through the heat exchanger core 8 from the inlet and outlet header 14, 16 between the alternate pairs 22 of heat exchanger plates 20. A second flow, Flow 2, passes through the heat exchanger core 8 from the first narrow side 10 to the second narrow side 12 between the intermediate pairs 24 of heat exchanger plates 20.

The first flow, Flow 1, is a hot flow and the second flow, Flow 2, is a cold flow, or vice-versa. The hot and cold fluid paths cross each other at about 90 degrees within the heat exchanger core and heat is transferred from the hot flow to the cold flow.

Figure 3:
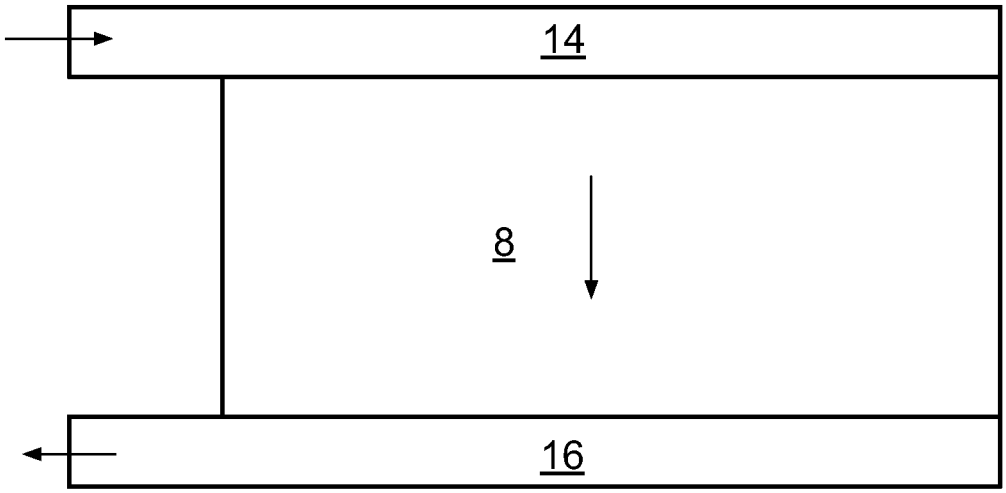
FIG. 3 is a front view of the heat exchanger of FIG. 2 showing the path of flow 1 through the heat exchanger.

As described, the first flow, Flow 1, enters the heat exchanger core 8 via the inlet header 14 and exits via the outlet header 16. Consequently, the path of the first flow, Flow 1, is a reverse C-shape, as shown in FIG. 3.

Described below is an embodiment of a fluid guiding member for assisting flow through the heat exchanger. The actual embodiment described below is in relation to a flow path for Flow 2. As such, the corresponding member for Flow 1 may comprise simple (i.e. planar) plates or walls. However such a flow guiding structure (as described below) may additionally or alternatively be applied to Flow 1. In an embodiment which may in some ways be preferred, the features described below are applied to both Flows 1 and 2, subject to careful attention being paid to the manufacture/assembly at the corners of the flow guide structure to ensure that flow paths through the heat exchanger do not become blocked.

Figure 5:
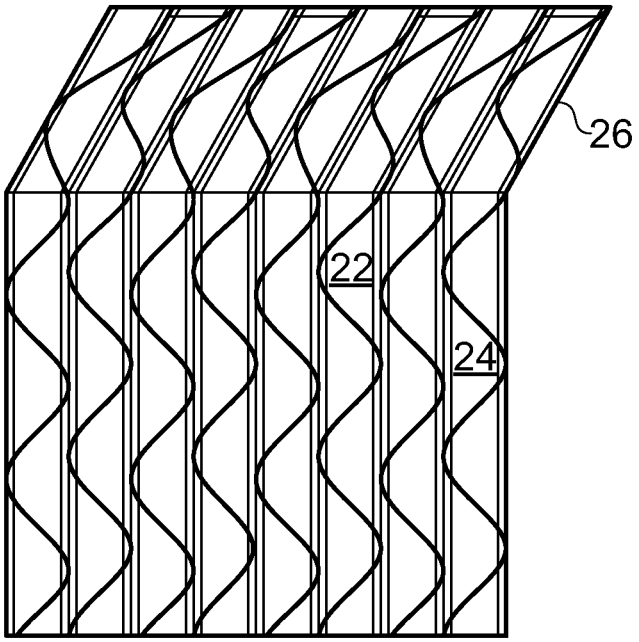
FIG. 5 is a side view of the heat exchanger of FIG. 4.

As shown in FIGS. 4 and 5, a fluid guiding member is provided to assist the second flow, Flow 2, in turning from the direction of the inlet header 10 to the direction of the fluid path through the heat exchanger plates 20 and/or from the direction of the fluid path through the heat exchanger plates 20 to the direction of the outlet header 12. The fluid guiding member is provided by an angled portion 26 of each heat exchanger plate 20 adjacent to the inlet and/or outlet header 14, 16. The angled portion 26 is angled with respect to the remainder of the heat exchanger plate 20

The heat exchanger plates 20 are provided with a series of corrugations 28 which run diagonally across the plates 20, i.e. at an oblique angle to the sides of the plate 20. Adjacent heat exchanger plates 20 are cross-corrugated such that their respective corrugations 28 run in opposite directions, crossing over one another at a point along their length.

The cross-corrugated configuration of the heat exchanger plates 20 promotes turbulence and mixing within the flow, which improves heat transfer and thus improves the efficiency of the heat exchanger 6.

Figure 6:
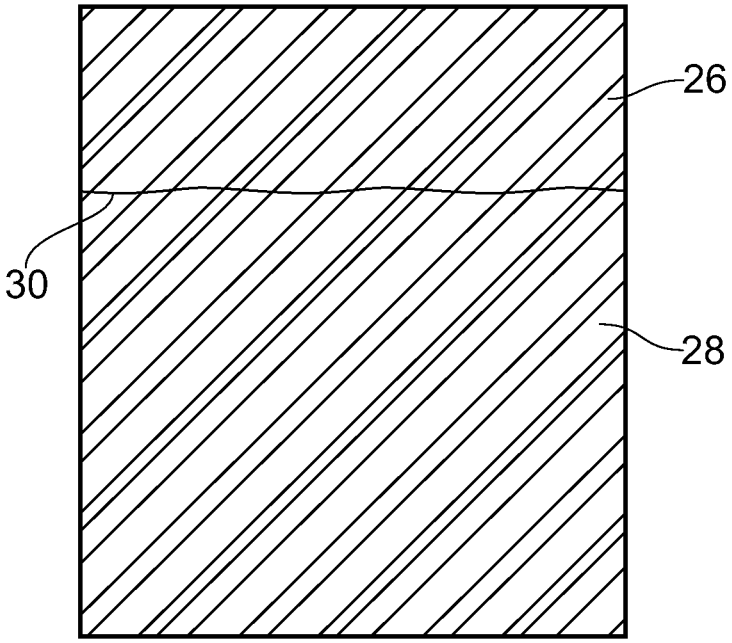
FIG. 6 is a front view of the heat exchanger of FIG. 4.

The formation of the angled portion 26 would cause the orientation of the corrugations 28 to deviate along their length when viewed from in front of the heat exchanger plates 20. To counteract this, the geometry of the corrugations 26 is sheared such that, following the formation of the angled portion 26, peaks and troughs of the corrugations 28 appear linear, as shown in FIG. 6. To shear the geometry of the corrugations 28, points of the corrugations 28 along a line 30 where the angled portion 26 meets the remainder of the heat exchanger plate 20 remain fixed, whereas other points of the corrugations 28 are translated parallel to the line 30 by a distance proportional to their perpendicular distance from the line 30.

Figure 7:
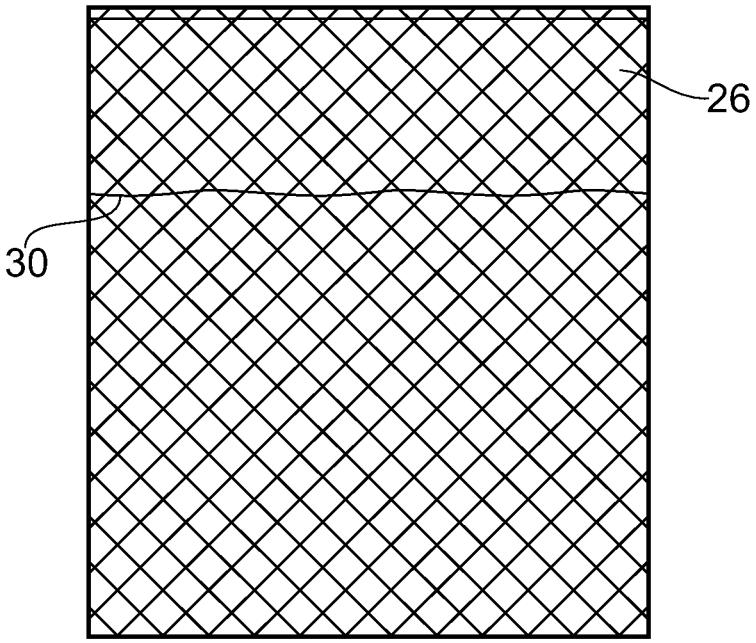
FIG. 7 is a wire frame model of the front view of FIG. 6 showing the effect on the corrugation path.

FIG. 7 shows a wire frame model of the front view of the heat exchanger plate 20 showing the effect on flow across the corrugations 28. As can be seen, by shearing the geometry of the corrugations 28, the 2D flow pattern is not affected by the angled portion 26. Shearing the geometry also prevents mechanical distortion by maintaining the pattern of contact points between peaks of adjacent heat exchanger plates 20. This method maintains the flow path on both sides of the heat exchanger (Flow 1 and Flow 2).

Figure 8:
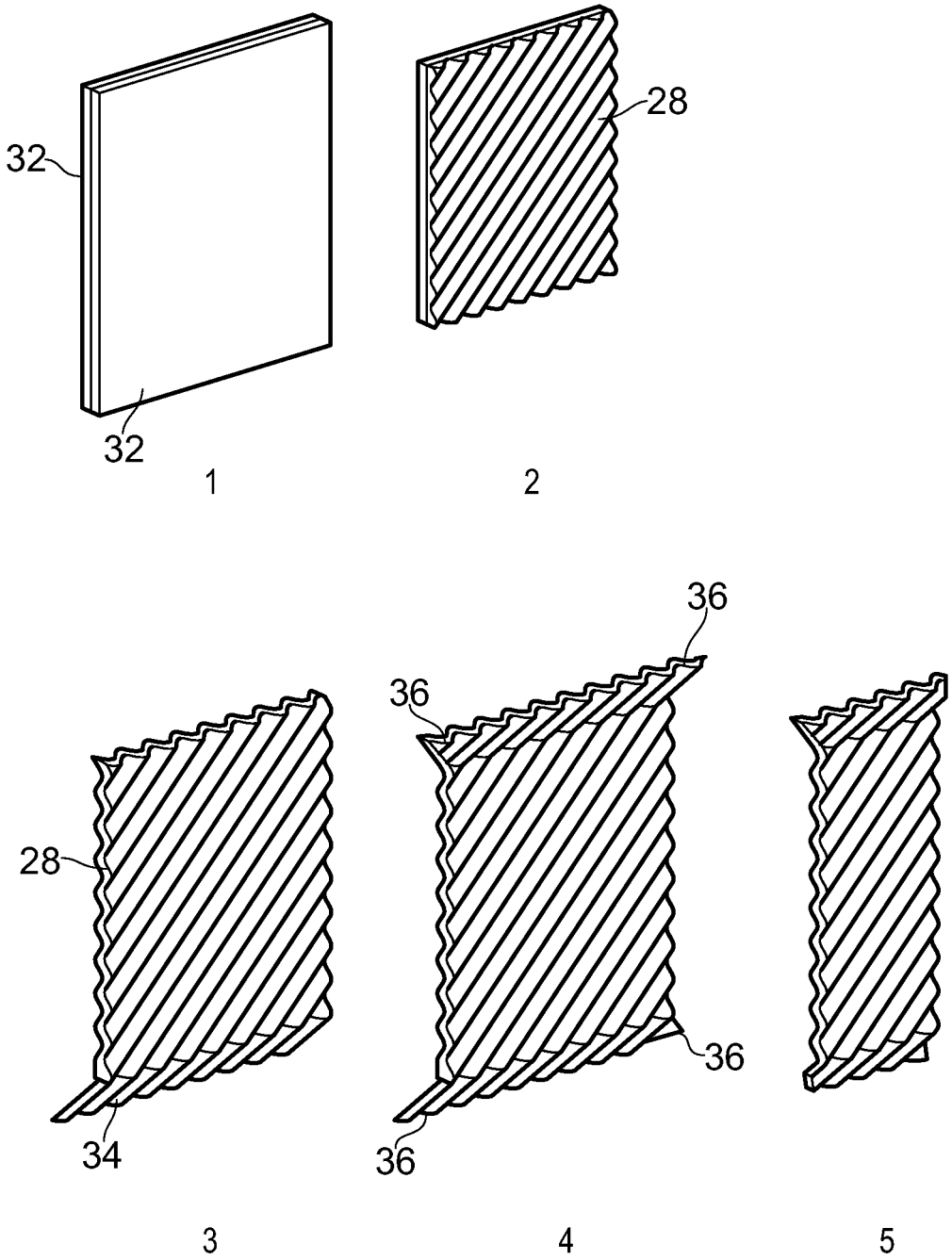
FIG. 8 is a perspective view of an embodiment of a method of manufacturing a heat exchanger plate according to another aspect of the invention.

FIG. 8 shows an embodiment of a method of constructing a heat exchanger plate 20.

Two separate sheets 32 of material are used to form the heat exchange plate 20 (step 1 as shown in FIG. 8). Corrugations 28 are formed in a surface of each of the two sheets 32 (step 2). The corrugations 28 are formed such that the corrugations 28 of the two sheets 32 are parallel when the un-corrugated surfaces of the two sheets 32 are facing each other. Sections 34 of the sheets which are to become the angled portion 26 are then sheared by extruding the sheets 32 at an angle (step 3).

The angle at which the sheets 32 are extruded is dependent on the desired angle of the angled portion 26 with respect to the remainder of the heat exchanger plate 20. Furthermore, the direction of shear depends on which way the angled portion is to be angled. For example, where the heat exchanger plate 20 forms a "Z" shape with the inlet at the top of the "Z" and the outlet at the bottom of the "Z", the section 34 adjacent the inlet will be sheared in the opposite direction to the section 34 adjacent the outlet. Conversely, where the heat exchanger plate 20 forms a "C" shape, the section 34 adjacent the inlet and the section 34 adjacent the outlet will be sheared in the same direction.

Subsequently, the two sheets are joined together (step 4) to form the heat exchanger plate 20 using a suitable joining process, with the un-corrugated surfaces of the two sheets 32 facing one another. As a result of the sheets being arranged so that their un-corrugated surfaces face one another, the sheared sections 34 are angled in opposite directions. Consequently, the sheets 32 do not overlap in regions 36 at the sides of the sheared sections 34. The regions 36 where the sheets 32 do not overlap are removed by trimming the heat exchanger plate 20 to the desired size (step 5).

Whilst the above steps describe some pertinent steps for construction of a suitable geometry, in reality, additional manufacturing steps would be required. The heat exchanger plates 20 would need to be hollow and so an operation to hollow the resulting solid would be undertaken. Manufacturing methods would also typically involve treating the resulting geometry, for example by electroplating the solid produced by the process of FIG. 8 and/or by stamping and joining plates so that the resulting shape would be the surface of the solid resulting from FIG. 8.

Figure 9:
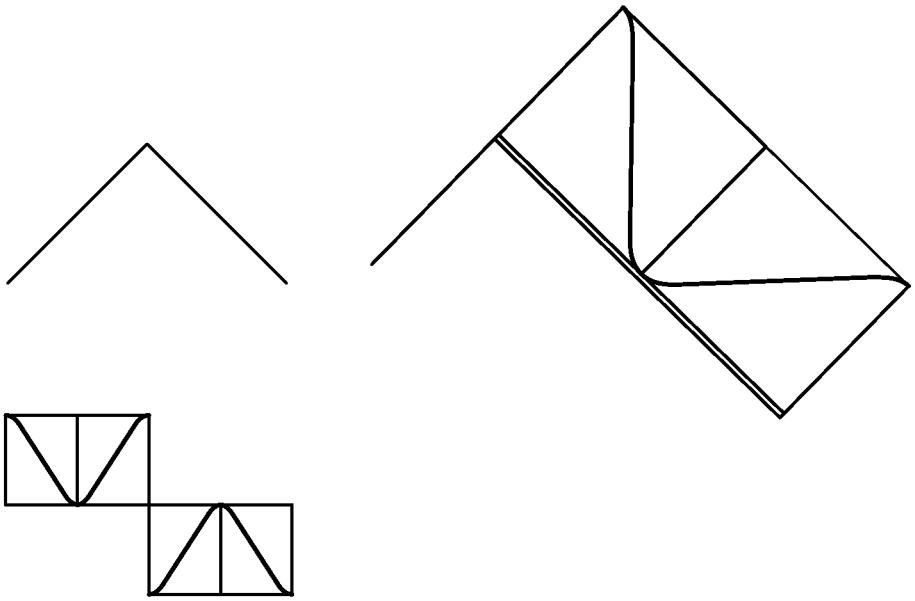
FIG. 9 is a parameterisation defining corrugations of the heat exchanger plates.

FIG. 9 provides a parameterisation which fully defines the corrugations 28 of the heat exchanger plates 20. As shown in view AE, the corrugations have an amplitude (the difference in height between a peak 38 and a trough 40) of 1.3 mm and a wavelength (the separation between adjacent peaks 38) of 2.86 mm. The peak 38 and troughs 40 have a radius of curvature of 0.286 mm and are interconnected by angled sides.

As described previously, the corrugations of adjacent heat exchanger plates 20 are arranged in a cross-corrugated manner, such that their peaks and troughs are perpendicular to one another, as shown in view AB. Furthermore, the distance between peaks 38 of the adjacent heat exchanger plates 20 is 2.6 mm as shown in view AC.

Figure 10:
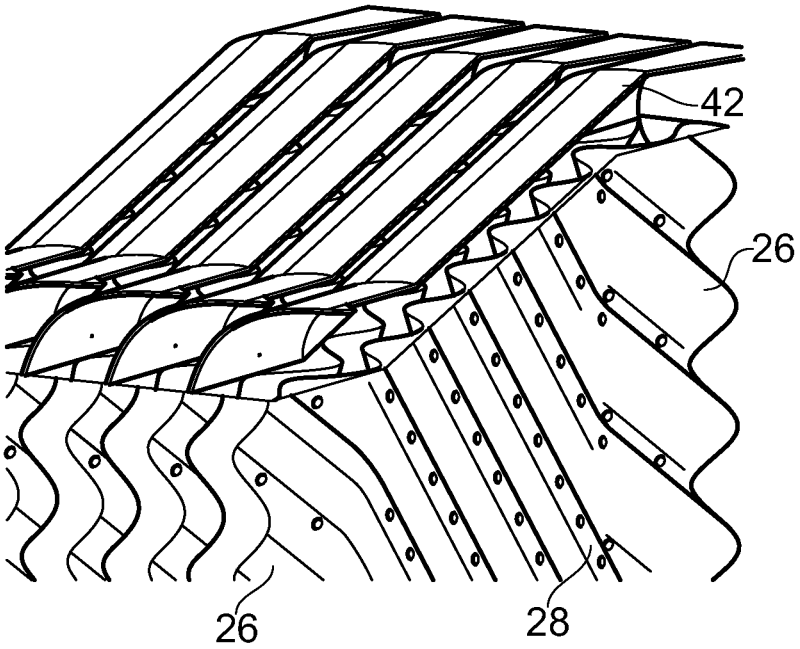
FIG. 10 is a perspective view of another embodiment of a heat exchanger.

FIG. 10 shows an external fluid guiding member which may be used to change the direction of the flow either independently or in combination with the angled portion 26 described previously. This external fluid guiding member comprises a curved plate 42 adjacent to the inlet and/or outlet side of each of the heat exchanger plates 20. The curved plate 42 is an elongate plate which is coupled to the heat exchanger plates 20 along their inlet and/or outlet side and is curved from the plane of the heat exchanger plates 20 towards the desired direction of flow. The curved plate 42 may have a constant thickness.

In FIG. 10, the curved plate 42 is located so as to change the direction of fluid flow at the outlet of the second flow, Flow 2. Furthermore, the curved plate 42 is shown in combination with the angled portions 26 which are used to change the direction of fluid flow at the inlet and outlet of the first flow, Flow 1. Consequently, the curved plate 42 is also profiled along the length of the heat exchanger plates 20 so that it conforms to the profile of the angled portions 26.

Figure 11:
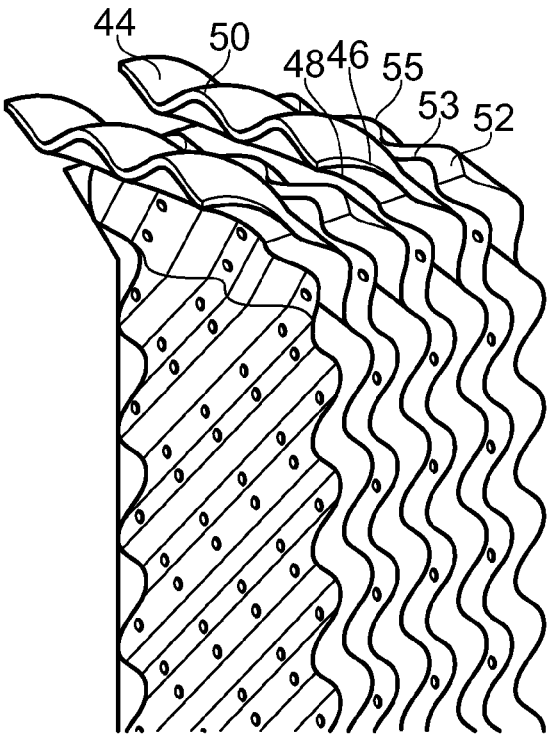
FIG. 11 is a perspective view of another embodiment of a heat exchanger.

FIG. 11 shows another external fluid guiding member which may be used to change the direction of the flow either independently or in combination with the angled portion 26 described previously. This external fluid guiding member comprises an aerofoil portion 44. Whereas the curved plate 42 has a constant thickness, the aerofoil portion 44 tapers towards its end. The aerofoil portion 44 has an upper surface 46 and a lower surface 48 which join at a point 50. The upper surface 46 and lower surface 48 are corrugated with the peaks of the corrugations running in the direction of the bulk flow.

An aerofoil portion 44 is located between the fluid paths of neighbouring pairs of heat exchanger plates 20, such that the fluid from one pair of heat exchanger plates 20 flows over the upper surface 46 and fluid from the other pair of heat exchanger plates 20 passes over the lower surface 48. As shown in FIG. 11, aerofoil portions 44 are located between alternate neighbouring pairs of heat exchanger plates 20.

The pairs of heat exchanger plates 20 terminate in a flat surface 52, which is located at a position where the corrugations 28 of adjacent heat exchanger plates 20 are in phase. The flat surface 52 has an inner edge 53 and an outer edge 55 defined by the pair of heat exchanger plates 20. To form the upper surface 46 of the aerofoil portion 44, the outer edge 55 of the flat surface 52 is revolved about an axis positioned such that the surface of revolution is tangential to the outer edge 55 and at a radius chosen as a design parameter. Consequently, the upper surface 46 forms a continuous surface with the heat exchanger plate 20. Similarly, the lower surface 48 of the aerofoil portion 44 is formed by revolving the inner edge 53 of the flat surface 52 about a separate axis positioned such that the surface of revolution is tangential to the inner edge 53 and at a radius chosen as a design parameter. Again, this creates a continuous surface between the heat exchanger plate 20 and the lower surface 48. For the pairs of heat exchanger plates 20 which do not have an aerofoil portion 44, the heat exchanger plates 20 terminate in the flat surface 52.

Figure 12:
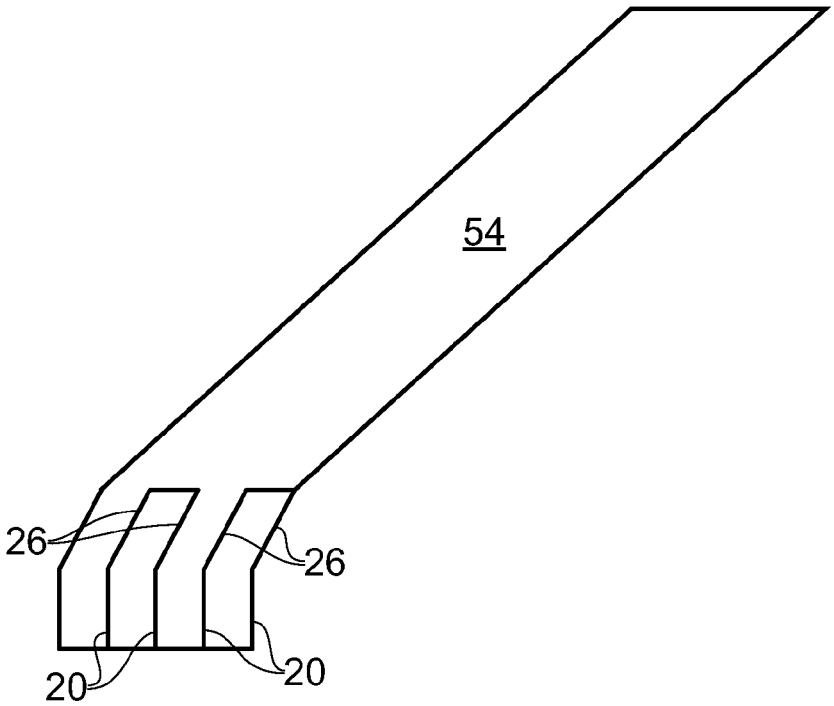
FIG. 12 is a sectional view of a computational domain for the flow path of the heat exchanger of FIG. 4.

A 2D section of the flow path between two pairs of heat exchanger plates 20 comprising an angled portion 26 is shown in FIG. 12.

Figure 13:
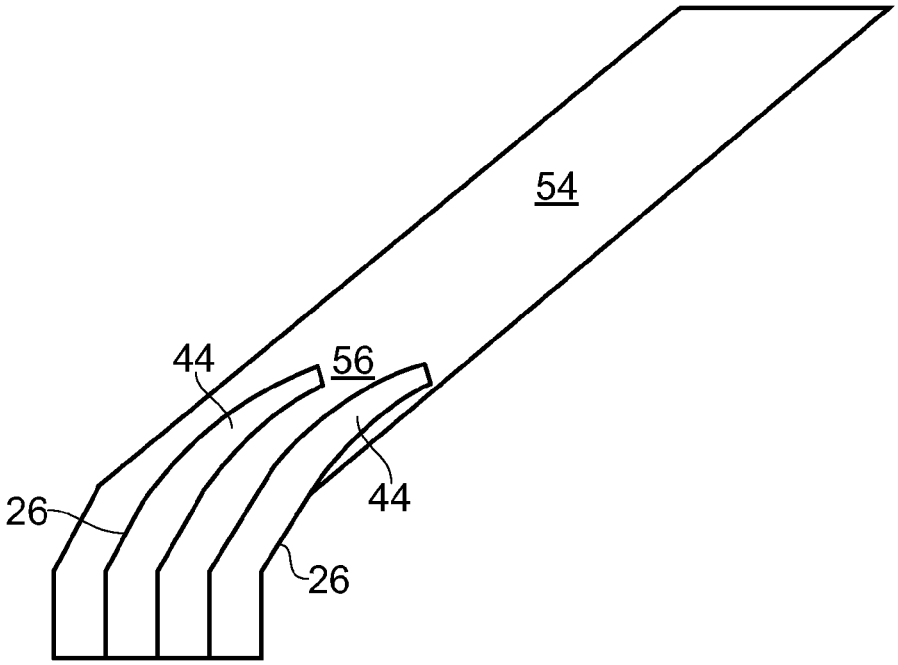
FIG. 13 is a sectional view of a computational domain for the flow path of another embodiment of heat exchanger.

An identical view is shown in FIG. 13 for two pairs of heat exchanger plates 20 having both an angled portion 26 and an aerofoil portion 44. As shown, the aerofoil portions 44 have double circular arc aerofoil profile, however other profiles may be used.

By having aerofoil portions 44 on both neighbouring pairs of heat exchanger plates 20, the mean free passage area 56 (i.e. the size of a sphere that is able to pass through the geometry) is reduced in the region of the aerofoil portions. As the turning angle of the aerofoil portion 44 increases (i.e. a larger arc length) the free passage becomes more constricted.

Figure 14:
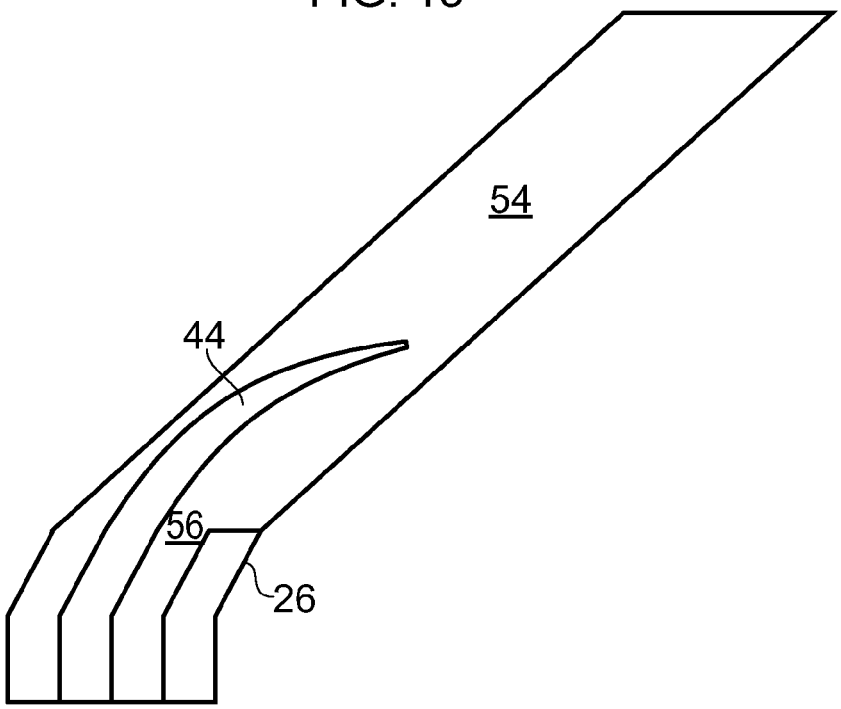
FIG. 14 is a sectional view of a computational domain for the flow path of the heat exchanger of FIG. 11.

As described with reference to FIG. 11, aerofoil portions 44 may be located between alternate neighbouring pairs of heat exchanger plates 20, particularly where a larger turning angle is required. Consequently, the mean free passage area 56 is increased, as shown in FIG. 14. A larger mean free passage area 56 reduces clogging in the heat exchanger core 8 leading to increased heat transfer.

Figure 15:
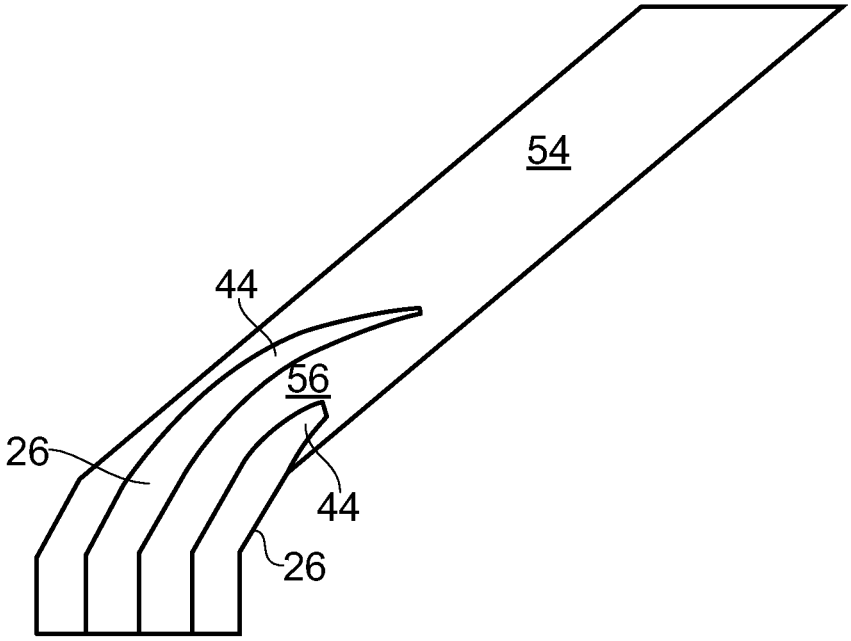
FIG. 15 is a sectional view of a computational domain for the flow path of another embodiment of a heat exchanger.

As an alternative, each neighbouring pair of heat exchanger plates 20 may be provided with an aerofoil portion 44, however, the aerofoil portions 44 of adjacent neighbouring pairs of heat exchanger plates may be dissimilar i.e. they have different arc lengths. This configuration provides turning of the flow whilst maintaining a suitably large mean free passage area 56, as shown in FIG. 15.

Figure 16:
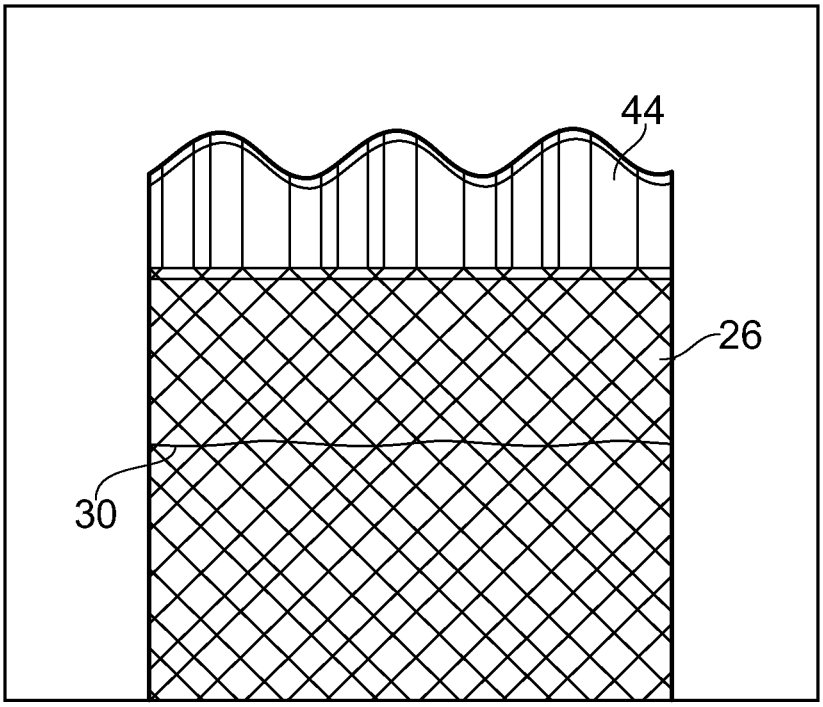
FIG. 16 is a wire frame model of a front view of the heat exchanger of FIG. 11 showing the effect on the corrugation path.

FIG. 16 shows the effect which the aerofoil portion 44 has on the flow through the heat exchanger. As shown, the aerofoil portion 44 turns the cross-corrugated flow in the plane of the bulk flow from the direction of the corrugations 28 to the bulk flow direction at the junction between the angled portion 26 and the aerofoil portion 44. This turning process results in a loss of total pressure. However, the bulk velocity is lower in the region of the heat exchanger plates 20 than in the region of the aerofoil portion 44 and consequently lower losses are experienced.

Figure 17:
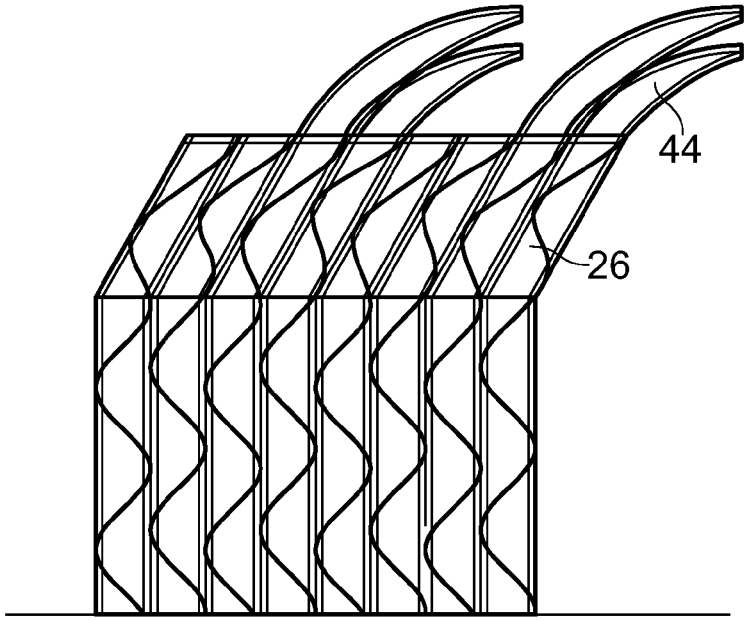
FIG. 17 is a wire frame model of a side view of the heat exchanger of FIG. 11 showing the effect on the corrugation path.
Figure 18:
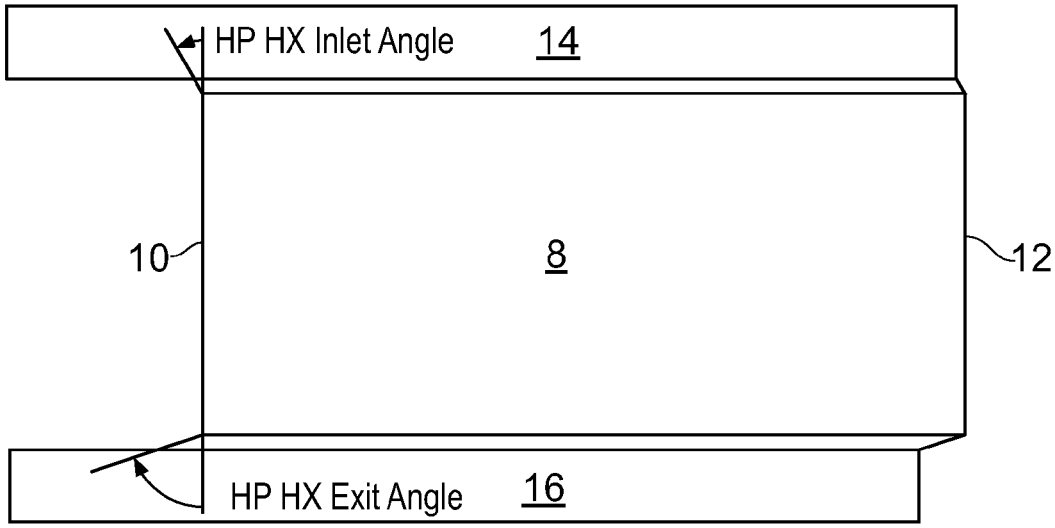
FIG. 18 is a front view of a heat exchanger according to the invention illustrating the change in direction of the flow into and out of the heat exchanger core.

As shown in FIG. 17, the direction of the flow is changed by the angled portion 26 and subsequently by the aerofoil portion 44. This fluid guiding member configuration may be employed at both the inlet and outlet to the heat exchanger core. Therefore, as shown in FIG. 18, this configuration can be used to guide the flow from the direction of the inlet header 14 towards the plane of the heater exchanger plates 20 and also from this plane towards the direction of the outlet header 16. The flow is preferably rotated by an inlet angle of approximately 30 degrees and by an exit angle of approximately 75 degrees.

Figure 19:
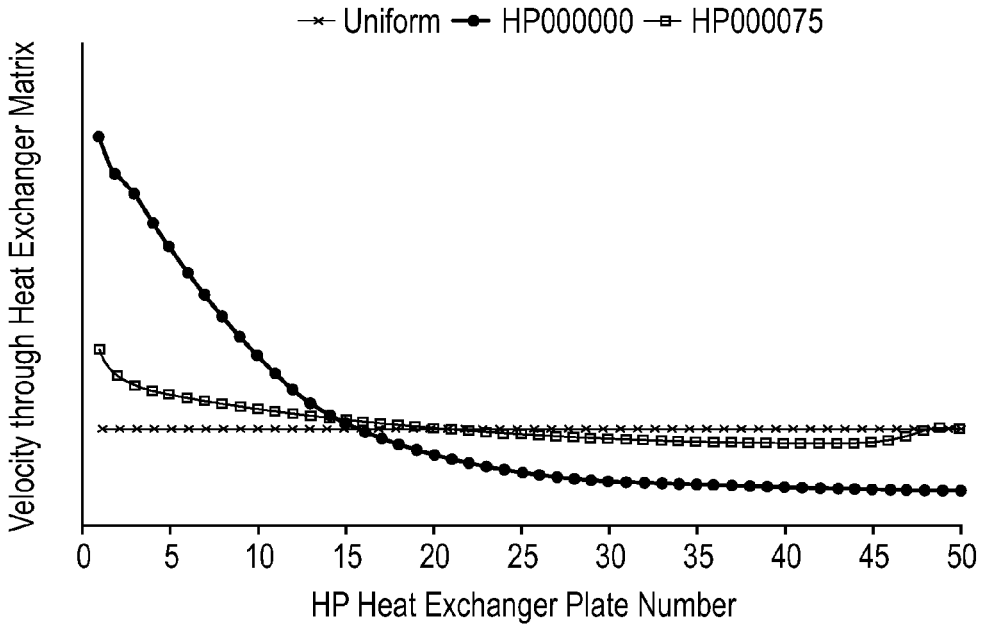
FIG. 19 is a graph showing the flow distribution across the heat exchanger core of FIG. 18 for a conventional heat exchanger and the heat exchanger of the invention.

FIG. 19 is a graph showing the distribution of flow within the heat exchanger core 8. The graph plots the velocity through each of the heat exchanger plates 20 from the first short side 10 to the second short side 12.

It is desirable to have a uniform distribution of flow through the heat exchanger core 8 in order to maximise the efficiency of the heat exchanger 6. This idealised distribution is shown by the "Uniform" line.

The "HP000000" line shows the distribution for a heat exchanger 6 without any fluid guiding means, whereas the "HP000075" line shows the distribution for a heat exchanger 6 with one or more of the fluid guiding members of the present invention which provide an exit angle of 75 degrees.

As can be seen, the flow within the heat exchanger without any fluid guiding means ("HP000000" line) has a larger velocity in the heat exchanger plates 20 towards the first short side 10. This indicates that the majority of the flow passes through these heat exchanger plates 20, thus reducing the efficiency of the heat exchanger 6.

In contrast, the "HP000075" line has a far more even distribution of flow within the heat exchanger core 8 and thus more closely resembles the "Uniform" line. The fluid guiding members of the present invention therefore provide a more efficient heat exchanger 6 with improved heat transfer properties.

Figure 20:
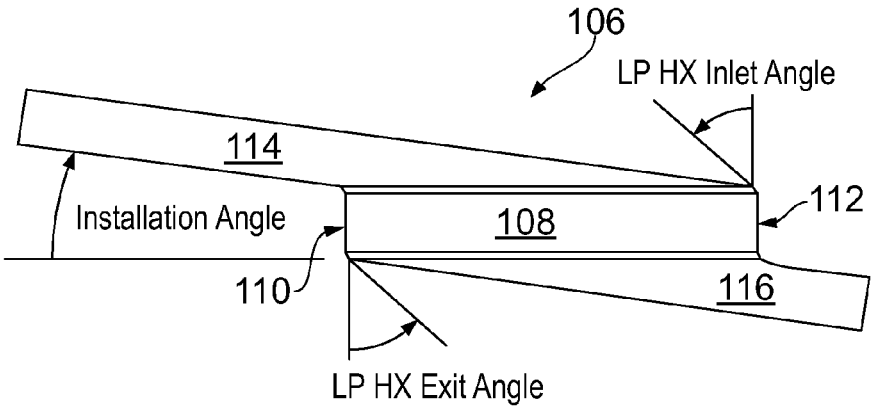
FIG. 20 is a top view of a heat exchanger according to the invention with an alternative configuration and illustrating the change in direction of the flow into and out of the heat exchanger core.

FIG. 20 shows a plan view of an alternative configuration of the heat exchanger. Whilst this embodiment is described as being separate to that of heat exchanger 6 of FIG. 2 for reasons of clarity, it will be appreciated that the view of FIG. 20 may also be considered representative of Flow path 2 of heat exchanger 6. Here, a heat exchanger 106 comprises a heat exchanger core 108 and inlet and outlet headers 114, 116. The heat exchanger core 108 has a first short side 110 and a second short side 112. The heat exchanger core 108 comprises a plurality of heat exchanger plates 20 (not shown) which spaced between the first short side 110 and the second short side 112 and are oriented in a plane which runs between the inlet and outlet headers 114, 116.

In the heat exchanger 106 the headers 114, 116 are located on opposite sides the heat exchanger core 108 such that the flow path through the heat exchanger core follows a "Z" shaped path. Again, one or more of the fluid guiding members of the present invention may be used to guide the flow from the direction of the inlet header 114 towards the plane of the heat exchanger plates 20 and also from this plane towards the direction of the outlet header 116. The flow is preferably rotated by an inlet angle of approximately 30 degrees and by an exit angle of approximately 75 degrees.

Figure 21:
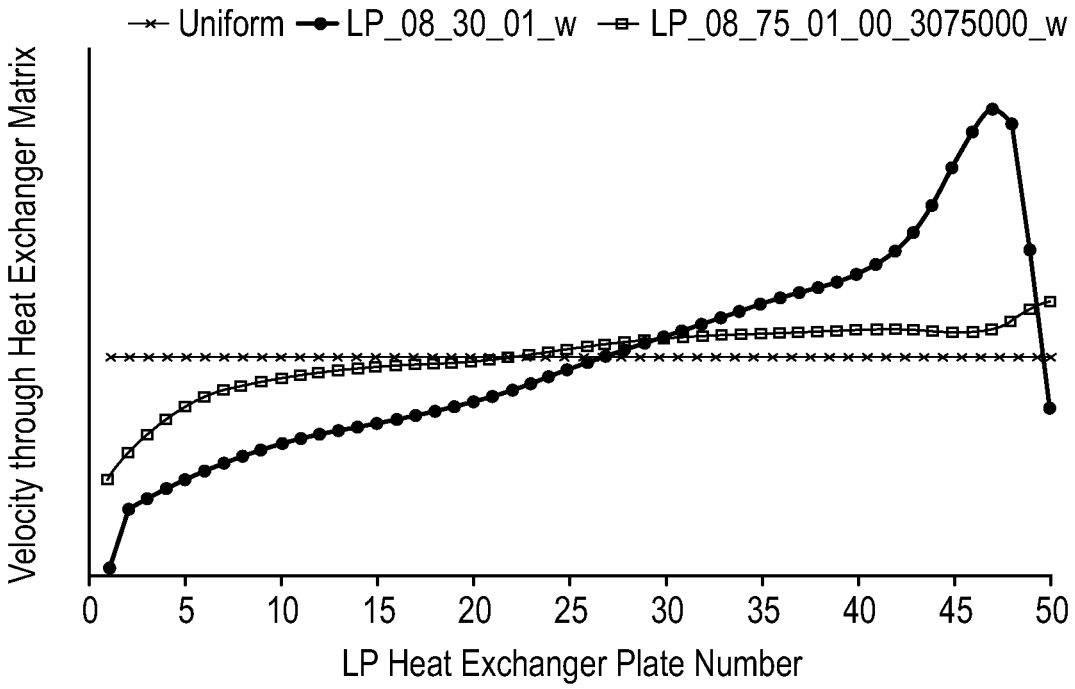
FIG. 21 is a graph showing the flow distribution across the heat exchanger core for a conventional heat exchanger and the heat exchanger of the invention with the configuration of FIG. 20.

FIG. 21 is a graph showing the distribution of flow within the heat exchanger core 108. The graph plots the velocity through each of the heat exchanger plates 20 from the first short side 110 to the second short side 112.

As for FIG. 19, the idealised distribution is shown by the "Uniform" line. The "LP_08_30_01_vy" line shows the distribution for a heat exchanger 106 with an inlet fluid guiding member which has an inlet angle of 30 degrees but without any fluid guiding means at the exit of the heat exchanger core 108. The "LP 08_75_01_00_3075000_vy" line shows the distribution for a heat exchanger 106 with one or more of the fluid guiding members of the present invention which provide an inlet angle of 30 degrees and an exit angle of 75 degrees.

As can be seen, the flow within the heat exchanger without any fluid guiding means at the exit of the heat exchanger core 108 ("LP_08_30_01_vy" line) has a larger velocity in the heat exchanger plates 20 towards the second short side 112. This indicates that the majority of the flow passes through these heat exchanger plates 20, thus reducing the efficiency of the heat exchanger 6.

In contrast, the "LP_08_75_01_00_3075000_vy" line has a far more even distribution of flow within the heat exchanger core 108 and thus more closely resembles the "Uniform" line. The fluid guiding members of the present invention therefore provide a more efficient heat exchanger 106 with improved heat transfer properties.

Although described with reference to a cross-corrugated heat exchanger, the present invention may find applications in other types of heat exchanger.

The corrugations have been defined with reference to the parameterisation of FIG. 9. However, the corrugations could alternatively have a sinusoidal, saw tooth or square wave type profile or any other type of profile. Furthermore, the corrugations could have a herringbone configuration or other configurations which are known to promote turbulence within the flow.

The heat exchanger of the present invention may be used as an intercooler in a primary gas path of a gas turbine engine. However, the heat exchanger could be used in any application, particularly where there are space constraints which result in the heat exchanger being installed at an angle.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

The invention claimed is:

1. A heat exchanger comprising:

a heat exchanger core comprising a plurality of corrugated heat exchanger plates;

a fluid path through the heat exchanger core, the fluid path running between adjacent heat exchanger plates and having an inlet at one side of the corrugated heat exchanger plates and an outlet at an opposing side of the corrugated heat exchanger plates; and a corrugated fluid guiding member in series flow with the inlet and/or the outlet side of corrugations of one corrugated heat exchanger plate of the plurality of corrugated heat exchanger plates, the corrugated fluid guiding member comprising an angled portion of each of the corrugations of the corrugated heat exchanger plate, wherein the corrugated fluid guiding member is angled out of a plane of the corrugated heat exchanger plate so as to provide the corrugations of the corrugated heat exchanger plates with an out of plane geometry, which is operable to change the direction of fluid flow away from the plane of the corrugated heat exchanger plate, and peaks and troughs of corrugations of the corrugated fluid guiding member and peaks and troughs of the corrugations of the corrugated heat exchanger plate are in-line when viewed in a direction perpendicular to the plane of the corrugated heat exchanger plate.

2. A heat exchanger as claimed in claim 1, wherein the corrugated fluid guiding member changes the direction of fluid flow by approximately 30 degrees at the inlet of the fluid path and/or approximately 75 degrees at the outlet of the fluid path.

3. A heat exchanger as claimed in claim 1, wherein the corrugated fluid guiding member comprises an aerofoil portion which is located between the fluid paths of neighboring pairs of corrugated heat exchanger plates.

4. A heat exchanger as claimed in claim 3, wherein the aerofoil portion is located between alternate neighboring pairs of corrugated heat exchanger plates.

5. A heat exchanger as claimed in claim 3, wherein the aerofoil portion is located between neighboring pairs of corrugated heat exchanger plates, and wherein aerofoil portions of adjacent neighboring pairs of corrugated heat exchanger plates are dissimilar.

6. A heat exchanger as claimed in claim 1, wherein the corrugated fluid guiding member is integral with the corrugated heat exchanger plates.

7. A gas turbine engine comprising a heat exchanger as claimed in claim 1.

* * * * *